US010407131B1

(12) United States Patent
Ward

(10) Patent No.: US 10,407,131 B1
(45) Date of Patent: Sep. 10, 2019

(54) PLATFORM AND SYSTEM FOR BOAT

(71) Applicant: Bradley B. Ward, Seguin, TX (US)

(72) Inventor: Bradley B. Ward, Seguin, TX (US)

( * ) Notice: Subject to any disclaimer, the term of this patent is extended or adjusted under 35 U.S.C. 154(b) by 27 days.

(21) Appl. No.: 15/933,583

(22) Filed: Mar. 23, 2018

(51) Int. Cl.

| | |
|---|---|
| ***B63B 17/00*** | (2006.01) |
| ***B63B 15/00*** | (2006.01) |
| ***B63B 39/06*** | (2006.01) |
| ***B63B 39/00*** | (2006.01) |
| ***B63B 35/81*** | (2006.01) |
| ***B63B 17/02*** | (2006.01) |
| ***B63B 41/00*** | (2006.01) |

(52) U.S. Cl.
CPC ..... *B63B 17/00* (2013.01); *B63B 15/00* (2013.01); *B63B 17/02* (2013.01); *B63B 35/816* (2013.01); *B63B 39/00* (2013.01); *B63B 39/06* (2013.01); *B63B 39/062* (2013.01); *B63B 41/00* (2013.01)

(58) Field of Classification Search
CPC ..... B63B 15/00; B63B 17/00; B63B 17/02; B63B 17/023; B63B 2017/026; B63B 21/56; B63B 35/815; B63B 39/00; B63B 39/06; B63B 39/062; B63B 2039/065; B63B 2039/067; B63B 41/00; B63B 2041/003; B63B 2041/006
See application file for complete search history.

(56) References Cited

U.S. PATENT DOCUMENTS

| | | | | |
|---|---|---|---|---|
| 3,724,595 | A * | 4/1973 | Green | B63B 35/14 182/113 |
| 5,590,616 | A * | 1/1997 | Vera | B63B 1/14 114/261 |
| 7,108,570 | B2 * | 9/2006 | Okuyama | B63B 49/00 440/84 |
| 7,152,548 | B2 * | 12/2006 | Barstow | B63B 27/16 114/315 |
| 7,497,184 | B1 * | 3/2009 | Chaffin | B63B 15/00 114/353 |
| 8,075,353 | B2 * | 12/2011 | Suzuki | B63H 21/22 440/1 |
| 8,281,732 | B1 * | 10/2012 | Irvine | B63B 9/04 114/343 |
| 8,495,967 | B2 | 7/2013 | Williams et al. | |
| 9,446,818 | B2 * | 9/2016 | Dougherty | B63B 15/00 |

* cited by examiner

*Primary Examiner* — Ajay Vasudeva
(74) *Attorney, Agent, or Firm* — Hunt Pennington Kumar & Dula, pllc

(57) ABSTRACT

The present disclosure provides a platform system for a boat, including a wake tow tower, a platform supported on the wake tow tower, a safety rail above the platform, and a stabilizing fin supported at least partially below a waterline adjacent a major side of the hull to resist uncontrolled movement of the boat during usage of the platform by a person.

4 Claims, 7 Drawing Sheets

Locking hinge locks keels in either position

Water line
14
100
160
170
165
180
190
244
240
175
125
110
105
130
120
22
12
10
18
208
201
197
196

PLATFORM AND SYSTEM FOR BOAT

CROSS-REFERENCE TO RELATED APPLICATIONS

This application is related to provisional application Nos. 62/476,042 filed Mar. 24, 2017, 62/527,700 filed Jun. 30, 2017, and 62/583,657 filed Nov. 9, 2017, (the "Parent Provisionals") the contents of which are expressly incorporated herein in entirety. This application claims priority to the Parent Provisionals and hereby claims benefit of the filing dates thereof pursuant to 35 U.S.C. 119(e).

FIELD OF THE INVENTION

The present disclosure relates to recreational boats and wake tow towers for installation on recreational boats.

BACKGROUND OF THE INVENTION

Many people enjoy recreational watersports and boating activities. Boats used for towing wakeboarders and waterskiers may include a wake tow tower installed on the boat to provide a rope tow connection point. Need exists for improvements of wake tow towers to expand the uses and functions of boats equipped with such wake tow towers.

BRIEF SUMMARY OF THE INVENTION

The disclosed subject matter includes a platform system (hereinafter "system" or "platform system"), and platform apparatus (hereinafter "platform" or "platform apparatus"), for a recreational boat. Embodiments may include a platform system, including a wake tow tower, configured for installation on a recreational boat. Embodiments may include a boat having an installed platform system including a wake tow tower.

A platform system as disclosed herein may provide additional space above the main deck, where people may stand, sit, or lie when aboard a recreational boat. A boat having a platform system as disclosed may have more passenger area than an identical boat lacking such a platform system. A platform system may provide an elevated tanning deck. A platform system may provide shade to areas in the passenger compartment of the boat, which may be desirable for those who would like to reduce sun exposure. A platform system may provide an elevated, stable, position from which individuals may jump or dive into the water surrounding the boat on which the platform is installed. A platform system may provide an elevated springboard for diving or jumping. A platform system may provide seating area and standing area above the main deck. A platform system may provide deployable stabilizing keel assemblies for reducing uncontrolled motion of the boat, such as resisting displacement of the boat at rest on the water, and reducing rocking of the boat at rest. Such uncontrolled motion of the boat may occur, for example, when individuals use the elevated platform, jump or dive from the elevated platform, or move about the boat, or when waves and wind exert forces that tend to cause uncontrolled motion or excessive rocking of the boat. A platform system may provide stabilizing keel assemblies that may be removed from the water and placed in a stored, raised position, or stowed, when the boat is operated to run across a body of water.

BRIEF DESCRIPTION OF THE DRAWINGS

The novel features believed characteristic of the disclosed subject matter will be set forth in any claims that are filed later. The disclosed subject matter itself, however, as well as a preferred mode of use, further objectives, and advantages thereof, will best be understood by reference to the following detailed description of an illustrative embodiment when read in conjunction with the accompanying drawings, wherein:

DETAILED DESCRIPTION OF ILLUSTRATIVE EMBODIMENTS

Figures 1, 2, 3, 4, 5, 6:
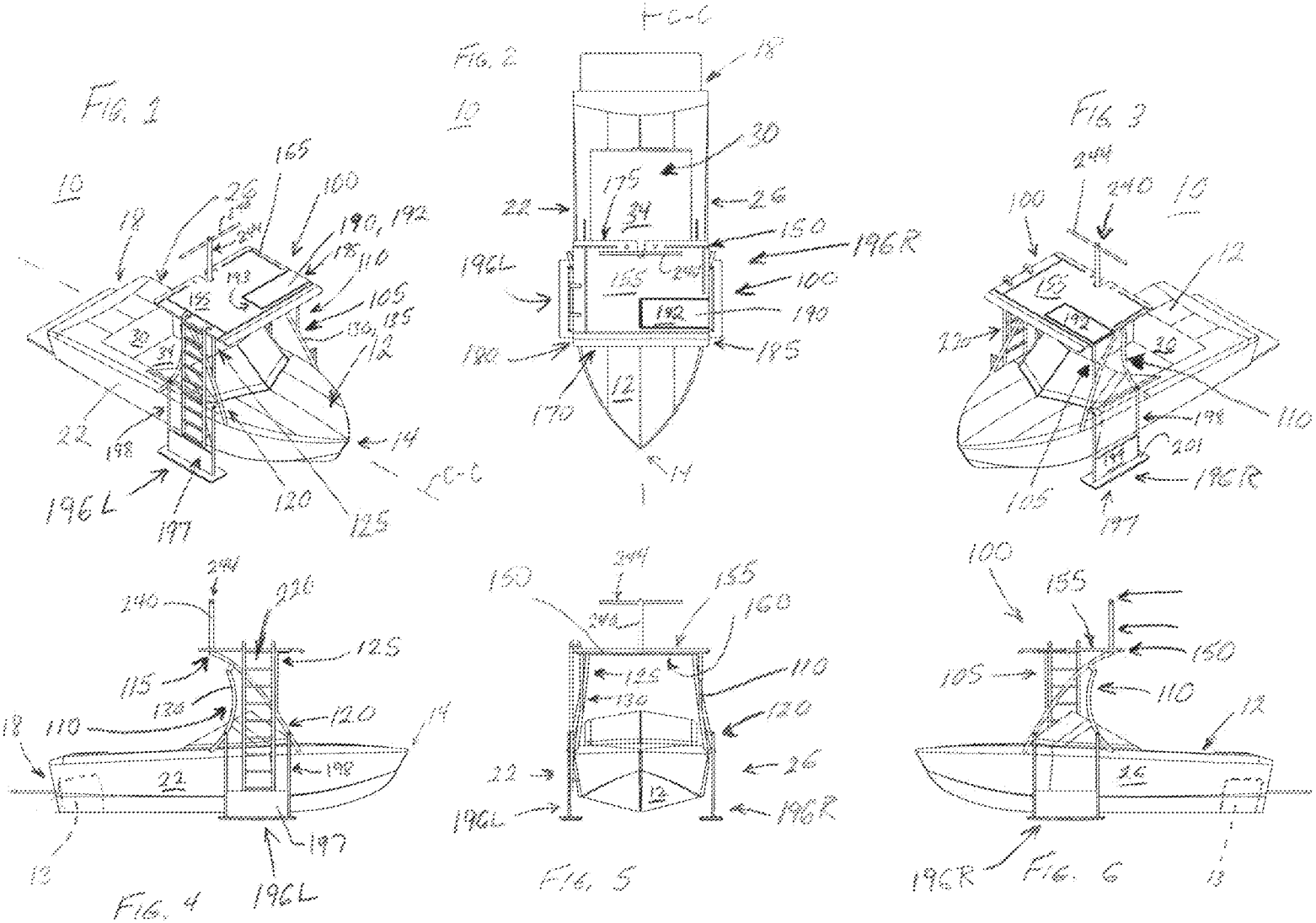
FIG. 1 depicts a simplified elevated left front perspective view of a boat having a platform system including diving springboard, with stabilizing keels in the deployed position, in an exemplary embodiment.
FIG. 2 depicts a simplified top plan view of the boat having a platform system including diving springboard, with stabilizing keels in a deployed position, shown in FIG. 1.
FIG. 3 depicts a simplified elevated right front perspective view of the boat, having a platform system including diving springboard and with stabilizing keels in the deployed position, shown in FIG. 1.
FIG. 4 depicts a simplified left side view of the boat, having a platform system including diving springboard and with stabilizing keels in the deployed position, shown in FIG. 1
FIG. 5 depicts a simplified front elevation view of the boat, having a platform system including diving springboard and with stabilizing keels in the deployed position, shown in FIG. 1.
FIG. 6 depicts a simplified right side view of the boat, having a platform system including diving springboard and with stabilizing keels in the deployed position, shown in FIG. 1
Figure 9:
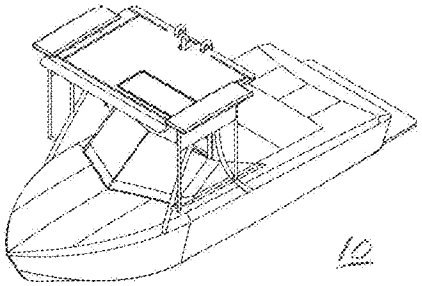
FIG. 9 depicts a simplified elevated right front perspective view of the boat, having a platform system including diving springboard and with stabilizing keels in the stored position, shown in FIG. 7.
Figure 12:
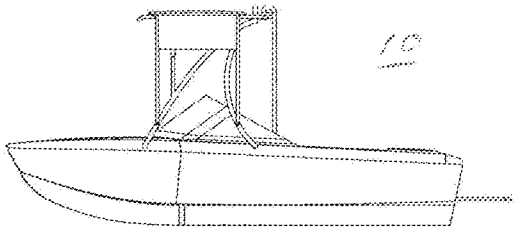
FIG. 12 depicts a simplified right side view of the boat, having a platform system including diving springboard and with stabilizing keels in the stored position, shown in FIG. 7.
Figure 8:
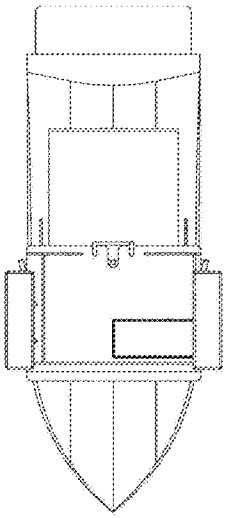
FIG. 8 depicts a simplified top plan view of the boat having a platform system including diving springboard, with stabilizing keels in the stored position, shown in FIG. 7.
Figure 11:
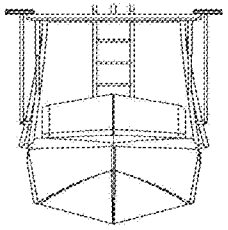
FIG. 11 depicts a simplified front elevation view of the boat, having a platform system including diving springboard and with stabilizing keels in the stored position, shown in FIG. 7.
Figure 7:
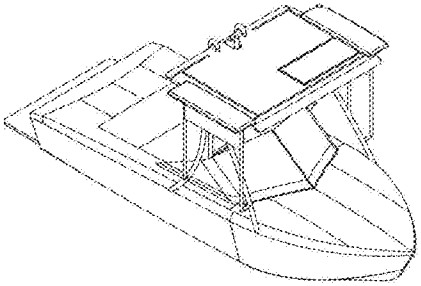
FIG. 7 depicts a simplified elevated left front perspective view of a boat having a platform system including diving springboard, with stabilizing keel assemblies in the stored position, in an exemplary embodiment.
Figure 10:
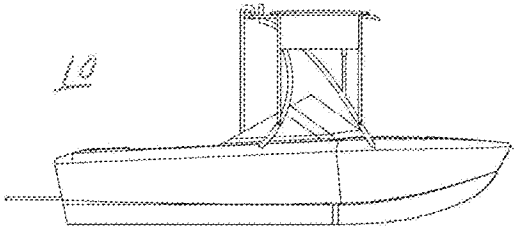
FIG. 10 depicts a simplified left side view of the boat, having a platform system including diving springboard and with stabilizing keels in the stored position, shown in FIG. 7.
Figure 15:
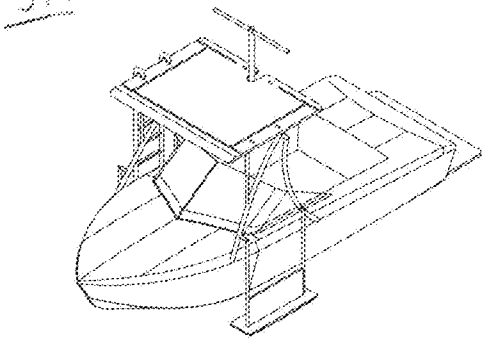
FIG. 15 depicts a simplified elevated right front perspective view of the boat, having a platform system with stabilizing keels in the deployed position, shown in FIG. 13.
Figure 18:
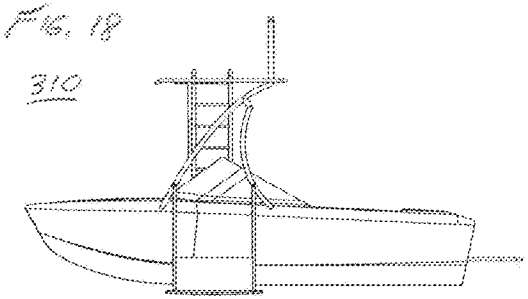
FIG. 18 depicts a simplified right side view of the boat, having a platform system with stabilizing keels in the deployed position, shown in FIG. 13.
Figure 14:
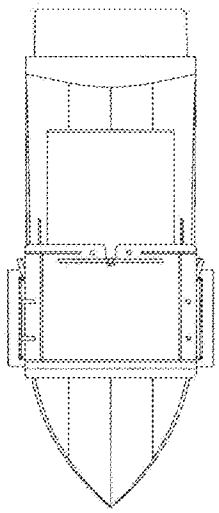
FIG. 14 depicts a simplified top plan view of the boat having a platform system with stabilizing keels in the deployed position, shown in FIG. 13.
Figure 17:
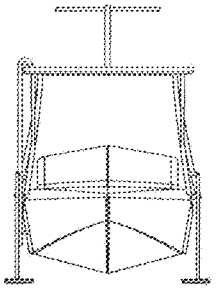
FIG. 17 depicts a simplified front elevation view of the boat, having a platform system with stabilizing keels in the deployed position, shown in FIG. 13.
Figure 13:
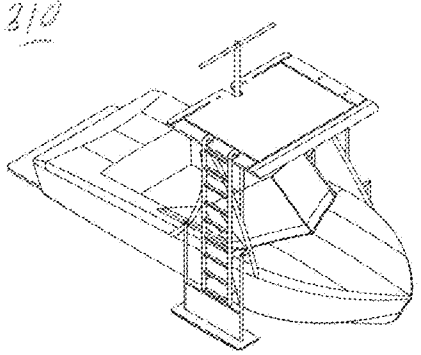
FIG. 13 depicts a simplified elevated left front perspective view of a boat having a platform system with stabilizing keels in the deployed position, in an exemplary embodiment.
Figure 16:
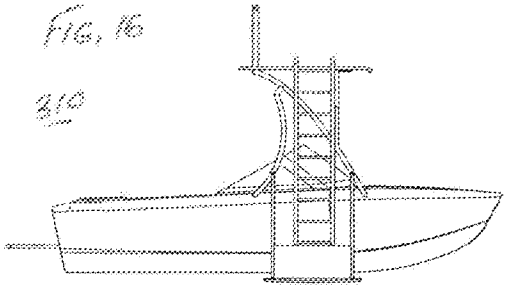
FIG. 16 depicts a simplified left side view of the boat, having a platform system with stabilizing keels in the deployed position, shown in FIG. 13.
Figure 20:
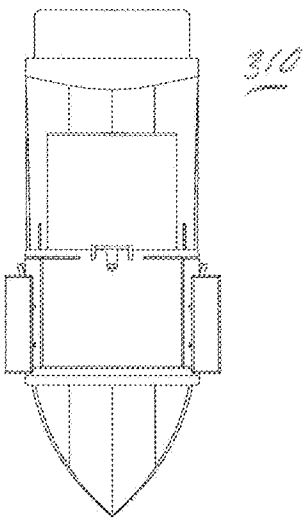
FIG. 20 depicts a simplified top plan view of the boat having a platform system with stabilizing keels in the stored position, shown in FIG. 19.
Figure 19:
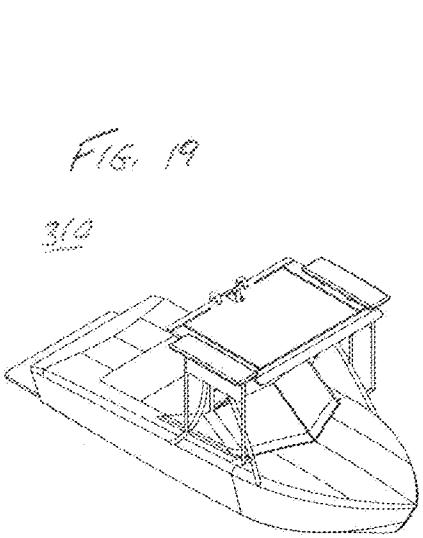
FIG. 19 depicts a simplified elevated left front perspective view of a boat having a platform system with stabilizing keels in the stored position, in an exemplary embodiment.
Figure 21:
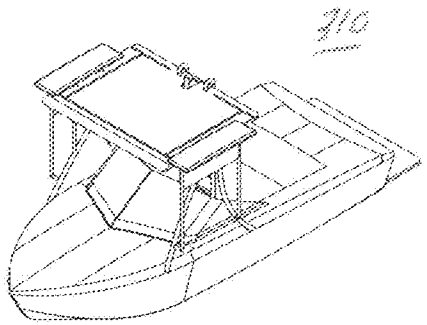
FIG. 21 depicts a simplified elevated right front perspective view of the boat, having a platform system with stabilizing keels in the stored position, shown in FIG. 19.
Figure 23:
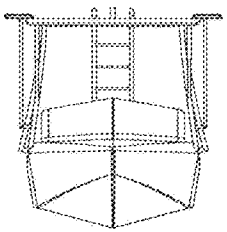
FIG. 23 depicts a simplified front elevation view of the boat, having a platform system with stabilizing keels in the stored position, shown in FIG. 19.
Figure 22:
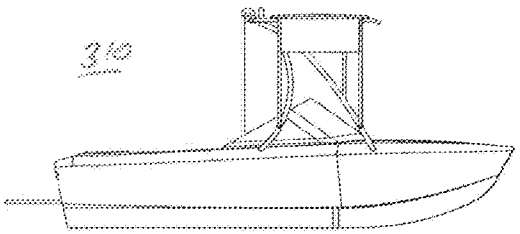
FIG. 22 depicts a simplified left side view of the boat, having a platform system with stabilizing keels in the stored position, shown in FIG. 19.
Figure 24:
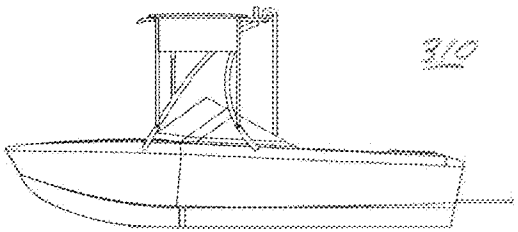
FIG. 24 depicts a simplified right side view of the boat, having a platform system with stabilizing keels in the stored position, shown in FIG. 19.

Reference now should be made to the drawings, in which the same reference numbers are used throughout the different figures to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

FIGS. 1-12 and FIGS. 25-29 illustrate a recreational boat 10 having a platform system 100. Boat 10 includes a hull 12 having a front 14, and rear 18. Boat 10 includes oppositely disposed elongated left side 22 and right side 26 each extending in parallel relationship from front 14 to rear 18. Boat 10 includes a propulsion unit 13 such as, for example, an inboard-outboard motor and propeller combination at rear 18. Boat 10 includes an open passenger compartment 30 having a main deck 34. Boat 10 has an elongated front-rear centerline C-C extending from front to rear along a longitudinal central axis. Boat 10 has a resting center of gravity (not shown) when at rest in water, and a moving center of gravity (not shown) when moving under power in the forward direction in water. It will be appreciated that locations of the resting center of gravity and moving center of gravity may change, for example, in relation to distribution and number of passengers in the passenger compartment 30 and on platform system 100.

Platform system 100 may include a platform support structure 105 mounted in fixed relationship relative to hull 12. As shown in the embodiments illustrated in FIGS. 1-6, the platform support structure 105 may include a wake tow tower 110 mounted in fixed relationship relative to hull 12. Wake tow tower 110 may have an elevated rope connection point 115 configured to pull a tow rope (not shown). Platform support structure 105 may include a lower structure 120 connected to hull 12, and an upper structure 125 supported by lower structure 120. Lower structure 120 may be joined in integral fixed relationship with upper structure 125. Platform support structure 105, including lower structure 120 and upper structure 125, may include a plurality of interconnected elongated structural members 130 forming an open lattice structure 135.

Figure 31:
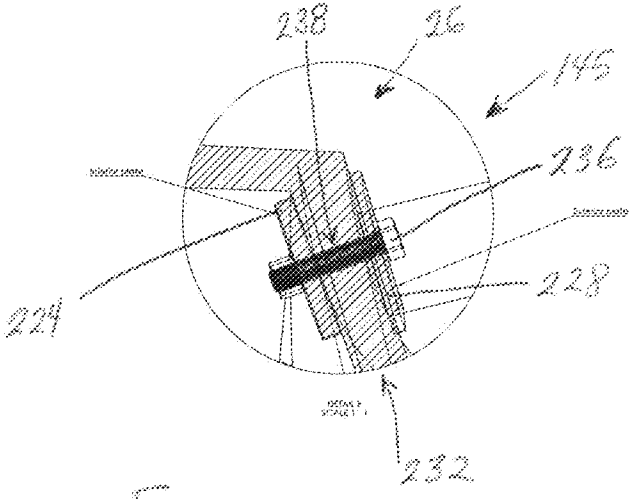
FIG. 31 is a simplified partial cross-sectional view taken generally along 31-31 in FIG. 30.
Figure 30:
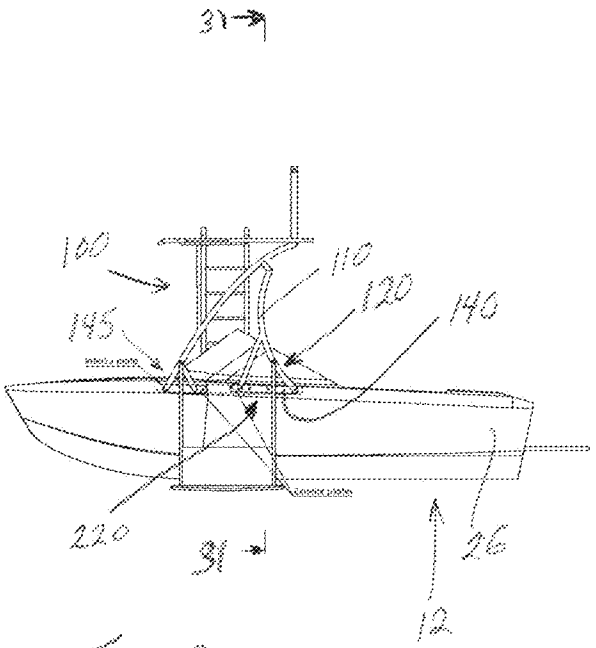
FIG. 30 is a simplified enlarged partial side view showing aspects of a platform support structure including a wake tower, including a first load distribution assembly with first mounting hardware joining a lower structure and hull.

Platform system 100 may include first load distribution assembly 140 joining lower structure 120 with hull 12. First load distribution assembly 140 may include first mounting hardware 145 joining lower structure 120 and hull 12. First load distribution assembly 140 is configured to distribute loads from platform support structure 105 across hull 12 to prevent damage or failure of hull 12. As shown in FIGS. 30-31, first load distribution assembly 140 may include at each of the left side 22 and right side 26 a set of mounting plates 220, such as a pair of mounting plates including both an internal mounting plate 224 and external mounting plate 228 (see FIG. 31) joined through the sidewall 232 of hull 12 by a plurality of spaced threaded bolt and nut connectors 236 each extending through a respective bolt hole 238, and configured to distribute weight and forces of the platform system 100 through lower structure 120 thereof and through the set of mounting plates 220 across a large area of the hull 12, such as, for example, a large area of the sidewall 232 of hull 12 on both the left side 22 and right side 26. It will be understood that the load distribution assembly 140 may include components (not shown) such as a plate and frame members, or a structural frame, configured to be joined with portions of the hull 12 other than the sidewalls 232, such as the floor or internal structural members between the floor and bottom of the hull 12, to distribute forces across the other portions of the hull 12 and thus reduce forces on the sidewall 232 of the hull 12.

Platform system 100 may include elevated platform 150 supported above the hull 12 and above main deck 34. Platform 150 may be supported by upper structure 125 of platform support structure 105. Platform 150 may be supported in fixed relationship relative to platform support structure 105 and hull 12. Platform 150, when supported by upper structure 125, may be configured to have structural strength properties sufficient to support at least one individual (not shown) resting, residing upon, or making use of a deck surface 155 of platform 150. In an embodiment, a combination of platform 150 with upper structure 125 may have structural strength properties sufficient to support at least one individual (not shown) resting, residing upon, or making use of deck surface 155. Platform 150 may include a bottom surface 160 disposed in opposition to deck surface 155. Platform 150 may have a perimeter 165. Perimeter 165 may be any suitable shape and, in the particular embodiment illustrated in FIGS. 1-6 is rectangular. Perimeter 165, as shown in the particular embodiment illustrated in FIGS. 1-6, may be rectangular and may include elongated front side 170, elongated rear side 175 disposed in opposite, spaced parallel relationship to front side 170, and oppositely disposed elongated left end 180 and right end 185 intersecting front side 170 and rear side 175 at respective corners of the rectangular perimeter. Platform 150 may be of any suitable construction. In the particular embodiment shown in FIGS. 1-6, platform 150 has a unitary construction formed of material providing essential structural strength properties in the illustrated dimensions, such as fiberglass material, composite material, or structural plastic material. In an embodiment (not shown), at least a portion of the platform 150 may be formed of transparent material.

Platform system 100 may include an elevated springboard system 190 supported by at least one of upper structure 125 and platform 150. Springboard system 190 may include an elongated springboard member 192 supported by springboard supporting assembly (not shown). The springboard supporting assembly may be configured to support springboard member 192 in cantilevered relationship with the springboard supporting assembly and platform 150 to enable flexure of the springboard member 192 under load created by an individual diving therefrom, such that the springboard member 192 may spring back upward following flexure and accompanying downward displacement at the outer end 195 of the springboard member 192. The springboard supporting assembly may be configured to support springboard member 192 in cantilevered relationship with at least one of upper structure 125 and platform 150. Springboard member 192 may be located in a springboard pocket 193 of platform 150. Springboard member 192 may have a top side 193 located in common vertical alignment with deck surface 155 of adjacent platform 150, to function in mating relationship with deck surface 155 when springboard member 192 is not in use for diving.

Figures 25, 26, 27, 28:
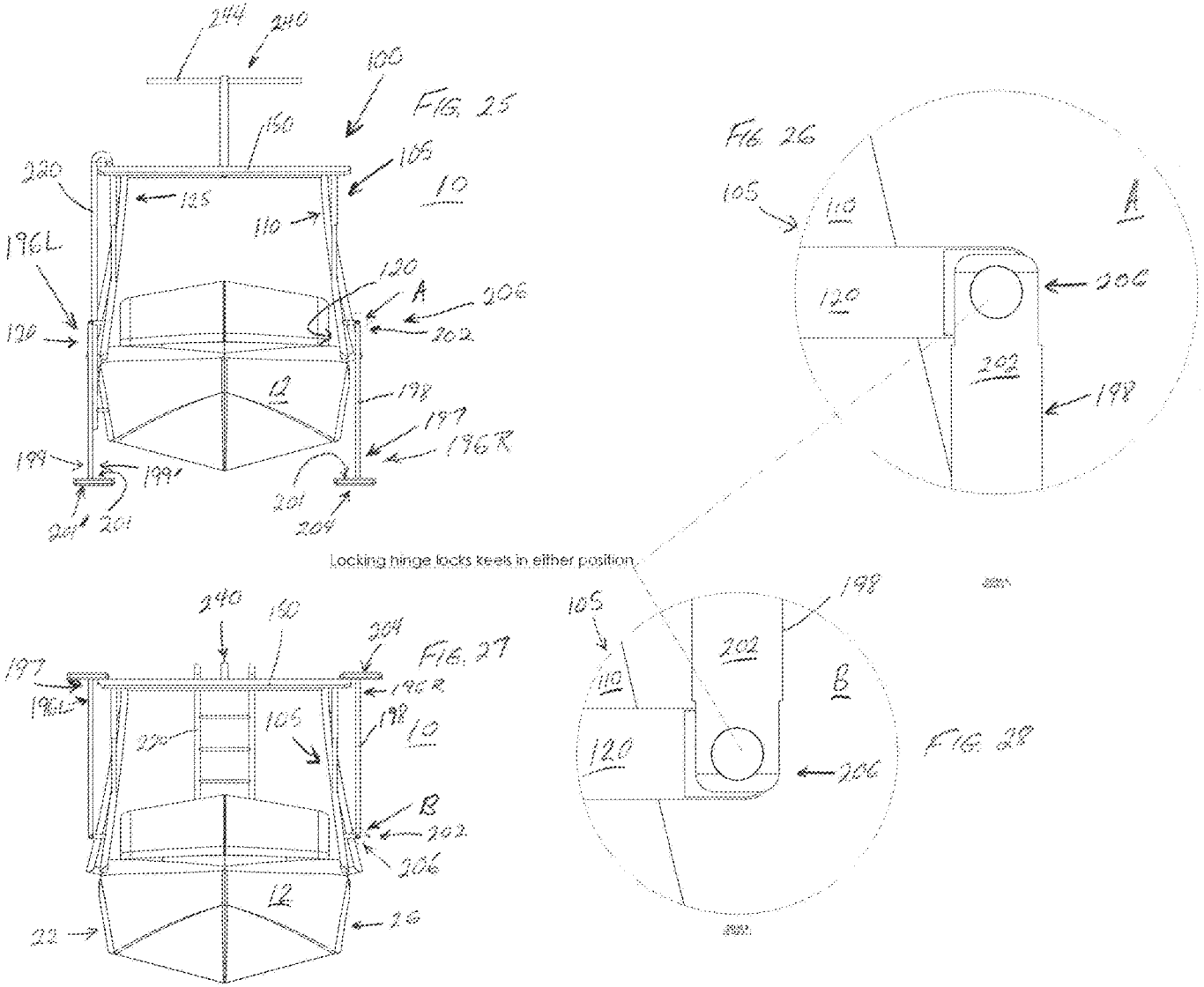
FIG. 25 depicts a simplified front view of the boat, having a platform system with stabilizing keel assemblies in the lower deployed position, shown in FIG. 5.
FIG. 26 is a partial enlarged view depicting detail area A shown generally in FIG. 25.
FIG. 27 depicts a simplified front view of the boat, having a platform system with stabilizing keel assemblies stored in the upper raised or stored position, shown in FIG. 7.
FIG. 28 is a partial enlarged view depicting detail area B shown generally in FIG. 27.
Figure 29:
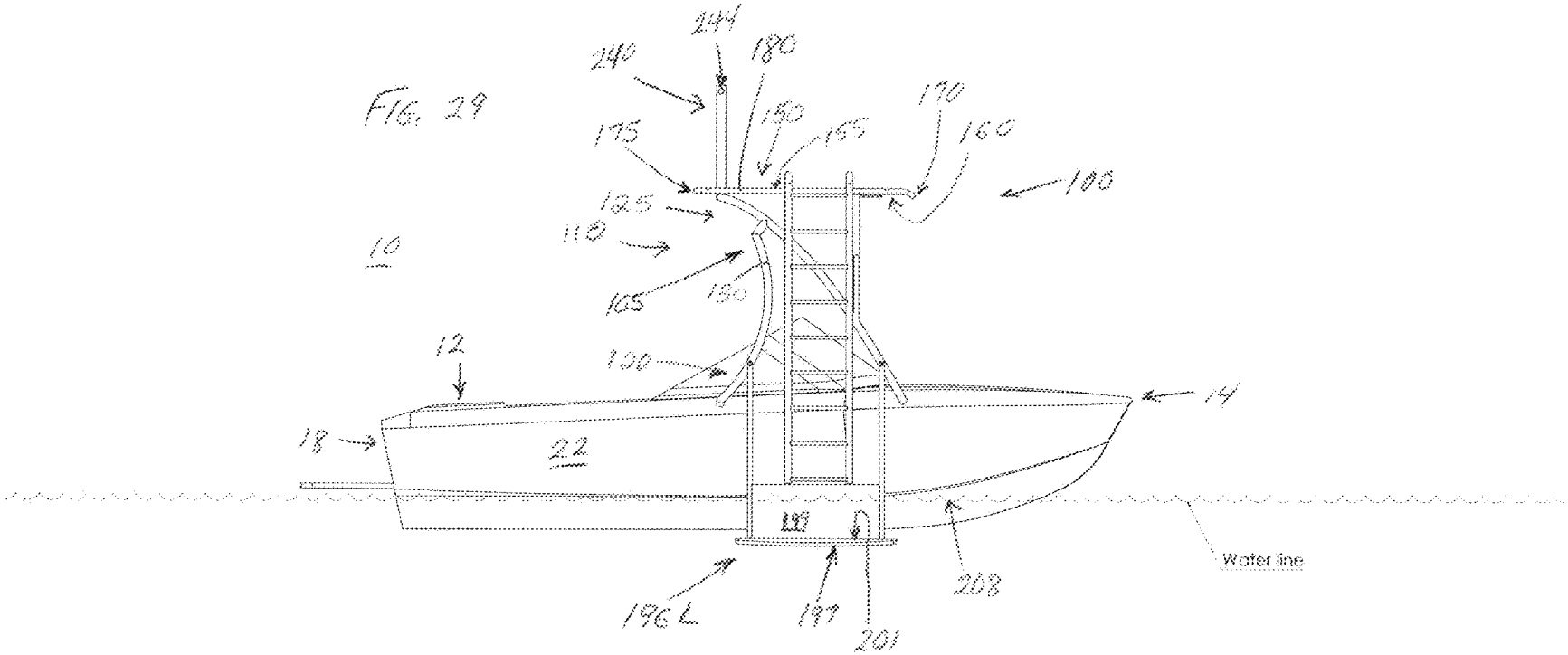
FIG. 29 is a simplified left side elevation view of the boat having a platform system with stabilizing keel assemblies in the lower deployed position as shown in FIG. 4, showing the boat floating in a body of water along a waterline.

Platform system 100 may include a pair of stabilizing keel assemblies 196L, 196R. Each of the stabilizing keel assemblies 196L, 196R may be supported for deployment to a lower deployed position shown in FIGS. 1-6. Each of the stabilizing keel assemblies 196L, 196R may be supported for storage in an upper stored position shown in FIGS. 7-12. Each of the stabilizing keel assemblies 196L, 196R may include at least one stabilizing fin 197 and an elongated fin-supporting member 198. Referring to FIG. 25, fin-supporting member 198 may include an upper end 202 spaced above a lower end 204. Fin-supporting member 198 may be supported at the upper end 202 thereof by being mounted in supported relationship with at least one of lower structure 120 and hull 12. Fin-supporting member 198 may be selectively moveable between a lower deployed position (shown in FIGS. 1-6, 25, 26 and 29) and a raised or upper stored position (shown in FIGS. 7-12, 27 and 28). In the particular embodiment shown in FIGS. 1-12 and 25-29, fin-supporting member 198 is selectively moveable in pivoting relationship with lower structure 120 about a pivot joint 206 between the upper stored position and lower deployed position. In the particular embodiment shown in FIGS. 1-12 and 25-29, pivot joint 206 may be a locking hinge or locking hinged joint, which may be releasably locked in the upper stored position or lower deployed position. In the lower deployed position (shown in FIGS. 1-6, 25, 26 and 29), the at least one stabilizing fin 197 is located at least partially below the waterline 208 (shown in FIG. 29) and at least partially submerged in water adjacent to the hull 12. The at least one stabilizing fin 197 may have a pair of opposed major vertical surfaces 199 oriented to engage the water to oppose uncontrolled horizontal displacement of the hull 12 across the water in the lateral direction. The at least one stabilizing fin 197 may have a pair of opposed major horizontal surfaces 201 oriented to oppose vertical displacement of the hull 12 in the water in the downward and upward directions. When each of the stabilizing keel assemblies 196L, 196R is deployed with each of the at least one stabilizing fin 197 located in the water adjacent hull 12 in the lower deployed position shown in FIGS. 1-6, proximate the opposite left side 22 and right side 26, cooperation of the stabilizing keel assemblies 196L, 196R with the at least one of the lower structure 120 and hull 12, causes the water to exert upon the major surface 199 force resisting uncontrolled movements. As used herein, "uncontrolled movements" may include, without limitation, rocking, rolling, wobbling, pivoting, sliding, turning, side-to-side, lateral displacement, vertical displacement, and horizontal displacement of the hull 12 from an initial position, orientation, attitude and location in the body of water. In an embodiment (not shown), any of the following: the stabilizing keel assemblies, at least one stabilizing fin, and the fin supporting member may be selectively may be selectively positionable in a lower deployed position as described and illustrated, or removed and stored in the vessel. In an embodiment (not shown), the at least one stabilizing fin may be selectively affixed directly to the hull in the lower deployed position, or removed and stored in the vessel. In such embodiments, for example, the stabilizing fin may be affixed with hook and loop fastener combination or other suitable fastener combination.

As best shown in FIG. 25, in an embodiment each of the stabilizing keel assemblies 196L, 196R may include a complex stabilizing fin 197 having both a first vertical major surface 199 and opposed second vertical major surface 199', and both a first horizontal major surface 201 and opposed second horizontal major surface 201'. It will be understood that each one of such major surfaces may be disposed for engagement in opposition with the water, to oppose uncontrolled horizontal displacement of the hull 12 across the water in both the left direction and in the opposite right direction, and also to oppose uncontrolled vertical displacement of the hull 12 in the water in both the downward direction and in the opposite upward direction.

In the particular embodiment shown in FIGS. 1-6, the left and right stabilizing keel assemblies 196L, 196R in the lower deployed position may have stabilizing fins 197 located at least partially submerged below waterline 208 in direct contact and engagement with the water when the boat is floating in a body of water in an initial position or location, and occupies an initial attitude relative to the body of water, when a person is using the elevated platform. The portions of the stabilizing fins 197 that extend below the surface of the water may assist in reducing uncontrolled motion of the boat such as, for example, uncontrolled rocking from the initial attitude of the boat relative to the body of water or uncontrolled lateral displacement of the boat from the initial position or location on the body of water, that may occur when one or more persons occupies the platform 150 or when a person departs the platform 150 such as by diving of jumping off the deck surface 155 of the platform 150 or from the springboard member 192 into the body of water.

In the embodiment shown in FIGS. 1-6, left and right stabilizing keel assemblies 196L, 196R having stabilizing fins 197 may be located and supported to be deployed proximate each of the two major, opposite left and right sides 22, 26 of the hull 12. In embodiments, each stabilizing keel assembly 196L, 196R may be may be moveable to be raised, or may be removable, to be stored or stowed out of the water in a secured, raised position during operation or running of the boat 10 across the body of water under power. In embodiments, in order for the stabilizer fins to oppose and reduce lateral motion while minimally impacting the normal forward travel during running of the boat, each stabilizer fin may be shaped to present a large surface area that is aligned in parallel with the longitudinal axis and centerline C-C (best shown in FIG. 2) of the boat 12, and a small surface area that is aligned perpendicular to same. It will be understood that having the small surface area aligned perpendicular to the centerline C-C may enable running operation of the boat, for example at low speeds, in the forward or backward directions, will limit water drag on the stabilizing fin 197 and thus limit corresponding twisting forces exerted on the extension member and tower supporting the stabilizing fin 197.

In embodiments, such stabilizing fins 197 may have a multi-surface or complex cross sectional profile for also drawing the boat downward into the water during use of the platform 150 by a person, and such as during use of the platform 150 and springboard member 192 for diving or jumping into the body of water. It will be understood that the stabilizing fins 197 may be shaped and positioned to engage the water for the water to exert force against at least one portion or surfaces of the stabilizing fins 197 for the stabilizing fins 197 to resist movement relative to the water in at least one direction. It will be understood that the stabilizing fins 197 may include, for example, an enlarged head portion or enlarged foot portion to provide effective horizontal surface area engaged with the water in a horizontal plane, in addition to the stabilizing fin having an effective vertical surface area when in floating, submerged relationship with the water. In embodiments, the stabilizing fin 197 may have both effective vertical surface area portions to resist movement of the stabilizing fin 197 relative to the water in at least one horizontal direction and effective horizontal surface area portions to resist movement of the stabilizing fin 197 relative to the water in at least one vertical direction. It will be understood that, in an embodiment (not shown) a stabilizing fin 197 may be deployed below the waterline 280 directly beneath the hull 12 of the boat 10, such as directly below the centerline, and may be supported by an extension member extending under the hull 12 from the platform supporting structure 105 or hull 12. In embodiments (not show), a stabilizing fin 197 also may have at least one inflatable portion (not shown).

In embodiments (not shown), the platform system 100 may have an airfoil cross sectional shape along the front side 170 defining a forward edge, for shedding airflow around the platform system 100 from the front side 170 to the rear side 175 of the platform 150, and preventing such airflow from catching against the underside of the platform system 100 and exerting undesirable forces on the platform system 100, such as exerting an undesirable lifting force against bottom 160 of platform 150, so as to impede operation or running of the boat under power.

In an embodiment, as shown in FIGS. 1-12 and 25-29, platform system 100 may include a moveable ladder 220. Moveable ladder 220 may be installed in any of multiple locations to enable individuals to climb up and down between the platform 150 and passenger compartment 30 or hull 12. Moveable ladder 220 may be installed in any of multiple locations to enable individuals to climb up and down between the platform 150 and the body of water at the left side 22 or right side 26 of the boat 10.

In an embodiment, as shown in FIGS. 1-12 and 25-29, platform system 100 may include a safety structure 240 configured to be mounted on one of the platform support structure 105 including wake tow tower 110, and the platform 150. The safety structure 240 may have a safety rail 244 located at a safety rail vertical position spaced above the platform 150 and corresponding platform vertical position. The safety structure 240 may be configured to retain a person on the deck surface 155 in relation to the perimeter 165 of the platform 150 and to stop a person from falling off platform 150. Safety rail 244 may be oriented and proportioned to be manually grasped by a person on the deck surface 155. A shown in FIG. 27, safety rail 244 may be removable to be stowed away, or moveable to a stored position, during running operation of the boat 12 across the body of water.

In embodiments, platform system 100 may include the stabilizing keel assemblies 196L, 196R each having elongated fin-supporting member 198 that provides or defines a selected lever arm distance between the platform support structure 105, or hull 12, and stabilizing fin 197, wherein the lever arm distance is selected or determined to increase or cause desired stabilizing forces to be exerted on the platform support structure 105, or hull 12, from the elongated fin-supporting member 198 supporting the stabilizing fins 197, where such forces are exerted through the stabilizing fins 197 engaged with the body of water.

Apparatus and systems in exemplary embodiments are described and illustrated. Although specific embodiments are illustrated and described herein, it will be appreciated by those of ordinary skill in the art that any arrangement that is calculated to achieve the same purposes can be substituted for the specific embodiments shown. This application is intended to cover any adaptations or variations of the embodiments and disclosure. For example, although described in terminology and terms common to the field of art, exemplary embodiments, systems, methods and apparatus described herein, one of ordinary skill in the art will appreciate that implementations can be made for other fields of art, systems, apparatus or methods that provide the required functions.

In particular, one of ordinary skill in the art will readily appreciate that the names of the methods and apparatus are not intended to limit embodiments or the disclosure. Furthermore, additional methods, steps, and apparatus can be added to the components, functions can be rearranged among the components, and new components to correspond to future enhancements and physical devices used in embodiments can be introduced without departing from the scope of embodiments and the disclosure. One of skill in the art will readily recognize that embodiments are applicable to future systems, future apparatus, future methods, and different materials.

Terminology used in the present disclosure is intended to include all environments and alternate technologies that provide the same functionality described herein.

What is claimed is:

1. A platform system for a boat, the boat having a hull, said platform system comprising:

a platform support structure including a wake tow tower mounted on the hull;

a platform configured to be mounted on said platform support structure at a platform vertical position spaced above a main deck of the hull, said platform having a deck surface, said platform configured to support a person on said deck surface;

a safety structure configured to be mounted on one of the wake tow tower and said platform, said safety structure having a safety rail at a safety rail vertical position spaced above the platform vertical position, said safety structure configured to retain a person on said deck surface in relation to a perimeter of said platform;

a stabilizing keel assembly supported by the wake tow tower, said stabilizing keel assembly having a stabilizing fin located at least partially below a waterline proximate a major side of the hull to resist uncontrolled movement of the boat during use of the platform.

2. A platform system according to claim 1 and further comprising:

a springboard member associated with said platform.

3. A platform system according to claim 1 and further comprising:

wherein the wake tow tower includes an identified rope connection point configured for receiving a tow rope.

4. A system according to claim 1 and further comprising:

wherein said stabilizing fin is supported by an elongated fin-supporting member mounted to the wake tow tower.

* * * * *